US006688752B2

(12) United States Patent
Moore

(10) Patent No.: US 6,688,752 B2
(45) Date of Patent: Feb. 10, 2004

(54) ELECTRONICALLY SIMULATED FLAME

(76) Inventor: Wayne T. Moore, 100 Summerwinds La., Oldsmar, FL (US) 34677

( * ) Notice: Subject to any disclaimer, the term of this patent is extended or adjusted under 35 U.S.C. 154(b) by 0 days.

(21) Appl. No.: 09/974,888

(22) Filed: Oct. 11, 2001

(65) Prior Publication Data

US 2003/0072154 A1 Apr. 17, 2003

(51) Int. Cl.[7] ..... F21V 33/00

(52) U.S. Cl. ..... 362/234; 362/810; 362/800; 362/251; 315/200 A

(58) Field of Search ..... 362/800, 810, 362/234, 251; 315/200 A, 291, 292, 293, 294

(56) References Cited

U.S. PATENT DOCUMENTS 4,510,556 A 4/1985 Johnson
4,870,325 A 9/1989 Kazar
5,097,180 A 3/1992 Ignon et al.
5,585,783 A * 12/1996 Hall ..... 340/473
5,924,784 A 7/1999 Chilwnyj et al.
6,166,496 A * 12/2000 Lys et al. ..... 315/316
6,225,759 B1 * 5/2001 Bogdan et al. ..... 315/291
6,424,269 B1 * 7/2002 Pederson ..... 340/815.45
6,469,631 B1 * 10/2002 Pederson ..... 340/815.45
6,472,996 B1 * 10/2002 Pederson ..... 340/815.45

* cited by examiner

*Primary Examiner*—Alan Cariaso
*Assistant Examiner*—Jacob Y. Choi
(74) *Attorney, Agent, or Firm*—David Kiewit

(57) ABSTRACT

A two-dimensional array of light emitting diodes (LEDs), controlled by a flame simulation program running on a microprocessor, is used to simulate a relatively large flame, such as one might find in a garden torch. The cost and complexity of controlling the relatively large number of LEDs needed to simulate a large flame is reduced by arranging the individual LEDs into a two-dimensional array having the anodes of all the LEDs in one column (or row) connected in common to exactly one column buss, and the cathodes of all the LEDs in one row (or column) connected in common to exactly one row buss. The microprocessor acts to connect the vertically-oriented columns of the matrix to a source of electric power one at a time, and to then drive all of the rows by providing a multi-bit digitally encoded output to one or more digital-to-analog converters (D/A), each of which converts the encoded output to an analog voltage and that applies that voltage to a resistor ladder network connected to each horizontal row of LEDs in the matrix. The amplitude of the driving signal applied to any selected LED in a selected column of the matrix thus depends on both the voltage amplitude output by the D/A and the total value of electrical resistance due to the ladder network interposed between the D/A and the LED's row.

8 Claims, 4 Drawing Sheets

ELECTRONICALLY SIMULATED FLAME

BACKGROUND OF THE INVENTION

1. Field of the Invention

The present invention is generally related to the illumination arts and is more particularly concerned with ornamental or decorative illumination of the sort that simulates a flame. A specific example is the electronic simulation of a torch of the sort commonly referred to as a garden torch or a tiki torch.

2. Background Information

Candles, and other flames, are sometimes simulated by electrically powered illumination sources. Notable among the patented prior art in this area are:

U.S. Pat. No. RE37,168, wherein St. Louis discloses an approach to simulating a flickering candle by using a single incandescent lamp driven by two oscillators having slightly different frequencies so as to provide electric drive pulses having varying widths.

U.S. Pat. No. 5,924,784, wherein Chliwnyj et al. teach the use of a microprocessor running a flame simulation program to control the intensity of individual members of an array of lighting devices by controlling the width of electric driving pulses. The approach used by Chliwnyj et al. requires an individual control output to each controlled device, which substantially increases the cost of driving a large array of lighting devices, as is of interest when simulating a torch or other large flame.

U.S. Pat. No. 5,097,180, wherein Ignon et al. teach the simulation of a flickering candle light by using a plurality of independent analog oscillators to modulate the power supplied to a single incandescent filament.

U.S. Pat. No. 4,870,325, wherein Kazar discloses a flame simulation apparatus in which the intensity of a parallel-connected array of LEDs is controlled by a pulse-width modulation scheme.

U.S. Pat. No. 4,510,556, wherein Johnson teaches the use of a digital shift register to create pseudo-random voltage pulse trains for driving a set of three vertically spaced incandescent lamps. The uppermost lamp in Johnson's array is driven independently, while the two lower lamps are driven together.

BRIEF SUMMARY OF THE INVENTION

In a preferred embodiment, a relatively large flame, such as one might find in a garden torch, is simulated by means of a two-dimensional array of light emitting diodes (LEDs) controlled by a flame simulation program running on a microprocessor. The relatively large number of LEDs required for simulating a large flame can lead to expensive and complex control arrangements if each LED is separately controlled. The flame simulation of the invention reduces the magnitude of this problem by arranging the individual LEDs into at least one two-dimensional array having some selected number, N, of columns and another selected number, M, of rows, where the matrix has the anodes of all the LEDs in one column (or row) connected in common to exactly one column buss, and the cathodes of all the LEDs in one row (or column) connected in common to exactly one row buss. The microprocessor acts to connect the vertically-oriented columns of the matrix to a source of electric power one at a time, and to then drive all of the rows by providing a multi-bit digitally encoded output to one or more digital-to-analog converters (D/A), each of which converts the encoded output to an analog voltage and that applies that voltage to a resistor ladder network connected to each horizontal row of LEDs in the matrix. The amplitude of the driving signal applied to any selected LED in a selected column of the matrix thus depends on both the voltage amplitude output by the D/A and the total value of electrical resistance due to the ladder network interposed between the D/A and the LED's row.

The two-dimensional array used for flame simulation is preferably arranged so that it can be viewed from any horizontal direction. This may be done by arranging the array on the surface of an upstanding cylinder, or by using some selected number, preferably three or more, of flat arrays placed around a vertical axis so as to approximate a cylinder. It will be understood, moreover, that although the arrays described herein will be treated as comprising N columns with M LEDs in each column, one could make an array that served the same purpose but that had one or more columns having fewer than M rows. Arrangements of this sort provide for simulations with partially defective arrays, as well as simulations having a regular pattern of taller and shorter columns.

In preferred embodiments of the invention, although portions of the array are visible from any angle as a viewer walks around a simulative torch, some elements of the array are hidden from view regardless of the viewing position. If one considers a array comprising three subarrays disposed about a vertical axis, for example, at least one of the three subarrays will be hidden from view. In some such cases, there will be some number, n, of columns of light sources that are hidden, so that the viewer can see no more than N−n columns. In control arrangement used with some embodiments of the invention this lack of total visibility is used to decrease the number of column drivers required. This may be done by driving multiple columns at the same time, where the columns are grouped (normally paired) so that only one of the columns in the group is visible from any one viewing angle. Alternately, one can interleave the times at which columns are selected so as to drive the kth column on one face and then the kth column on a second fact. Those skilled in the art will realize that it is also possible to simulate flames with a two dimensional array of elements, all of which are viewable from a single location. In such cases, n=0.

Although the preferred light source for practicing the invention is a LED, it will be understood that many other light sources, such as incandescent lamps, arc discharge lamps, electroluminescent emitters, etc. could equally well be used.

A preferred embodiment of the invention comprises electronic apparatus for simulating a flame. The apparatus comprises a selected number, greater than one, of light sources arranged as an array of N vertical columns and M horizontal rows in which no more than N−n of the columns are visible from any one viewing location. Each of the light sources, which may be a LED, has two electrical terminals. A first electrical terminal of each of the M light sources in each column is electrically connected to a common output of a respective one of no more than N−n drivers and the second electrical terminal of each light source is connected in common with the second electrical terminals of all the other light sources disposed in the same row, as well as to a respective point on a resistive ladder network. There is also at least one D/A converter that has an output connected to a point on the resistive ladder network at which none of the second electric terminals are connected. A controller, which is preferably a microprocessor, provides a binary encoded output comprising at least two separate bit outputs to each of the at least one D/A converters and also provides a separate output to each of the N−n drivers. The total number of outputs from the controller is less than N×M.

A preferred embodiment of the invention comprises apparatus for simulating a flame by sequentially controlling a respective intensity of illumination provided by each of a selected number, greater than one, of light sources arranged in a vertically extending array. Each of the light sources has the capability of providing a respective intensity of illumination responsive to an amplitude of a voltage applied across its terminals. The apparatus also includes a controller that can operate under control of a flame simulation program stored in its memory to supply at least one binary-encoded output value at one of a plurality of output connections. There is also at least one digital-to-analog converter for receiving a binary-encoded output from the controller and for converting that value to a corresponding analog voltage. This analog voltage output is connected to the light sources through an electrical resistance, which may be provided by a resistive ladder network. Hence, the amplitude of the voltage actually applied across each of the light sources is determined jointly by the amplitude of the analog output signal and the value of the respective electrical resistance.

Another aspect of the invention is that it provides a method of simulating a flame by controlling a plurality of electrically-powered illumination sources spaced out at a selected number of positions along at least one vertical line, where each of the illumination sources is adapted to provide an illumination intensity responsive to a voltage supplied one of its respective input terminals. This method comprises the steps of: using a program stored in a memory of a computer to generate a sequence of binary-encoded values, each of which is representative of a respective illumination intensity; supplying the sequence of binary encoded values to at least one digital to analog converter where the sequence is converted to a corresponding sequence of analog voltage values; and applying the sequence of analog voltages to an input of a resistor ladder network that has the same selected number of output connections, each of which is connected to an input terminal of at least one of the illumination sources.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
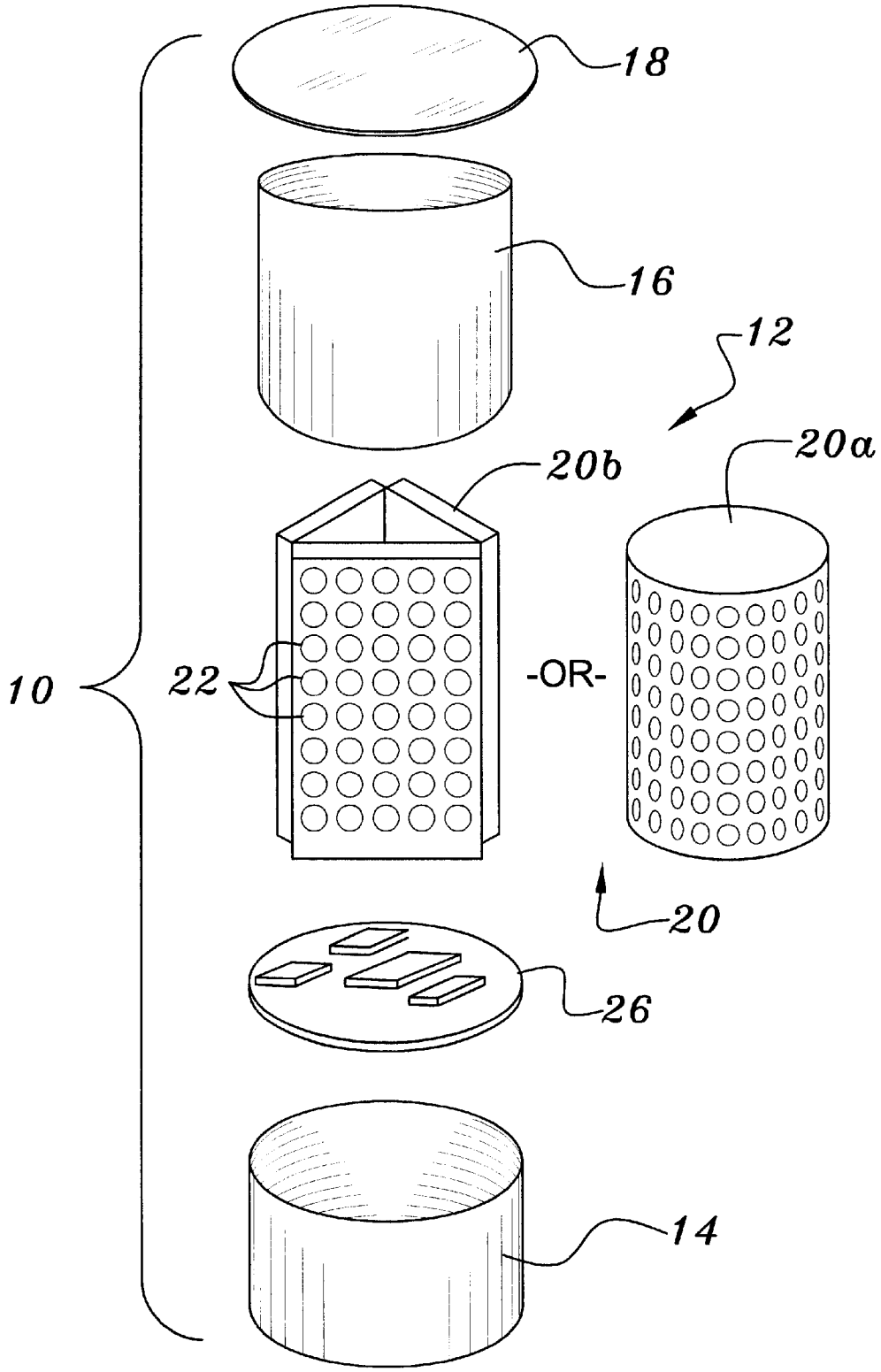
FIG. 1 is an exploded view of a flame simulation apparatus of the invention.

Although apparatus of the invention 10 may be used for simulating various sorts of flames, a preferred embodiment simulates a moderately large flame such as that of a torch of the sort commonly called a garden torch or a tiki torch 12. The torch 12 comprises a base 14, diffusion lens or housing 16, and weather cap 18 that cooperate to enclose an array 20 of light sources 22, which are preferably light emitting diodes (LEDs) 24, and electronic circuitry 26 that will be described in greater detail hereinafter.

The array 20 generally comprises a plurality of LEDs 24 arranged as a selected number, N, of vertical columns and another selected number, M, of horizontal rows. In some embodiments the array 20 may be arranged on a single plane surface. More commonly, when simulating a torch or other sizable flame, the array 20 is spread out across a surface or surfaces that enclose a volume comparable to that of a real flame. For example, the N×M array may be wrapped around the outer surface of a cylinder 20*a*, or may be arranged on the surface of several flat surfaces juxtaposed so as to form a faceted tube 20*b* that approximates a cylinder. When the array 20 is spread out on a cylinder, or, for that matter, on nearly any other non-plane surface(s), some of the light sources 22 will be hidden from view from some angles. For example, if the array 20 is arranged on a cylinder 20*a*, at most one half of the N columns will be visible from any viewing location. As will be discussed at greater detail subsequently, this allows someone who is designing such an array to share some of the driving circuitry and drive multiple columns at the same time. Generally speaking, if some number, n, of the N columns are known to be hidden, a designer need use only N−n drivers to control all N columns. In using this formality for describing the apparatus, it will be recognized that if all the LEDs are visible from a single location, n=0.

Figure 2:
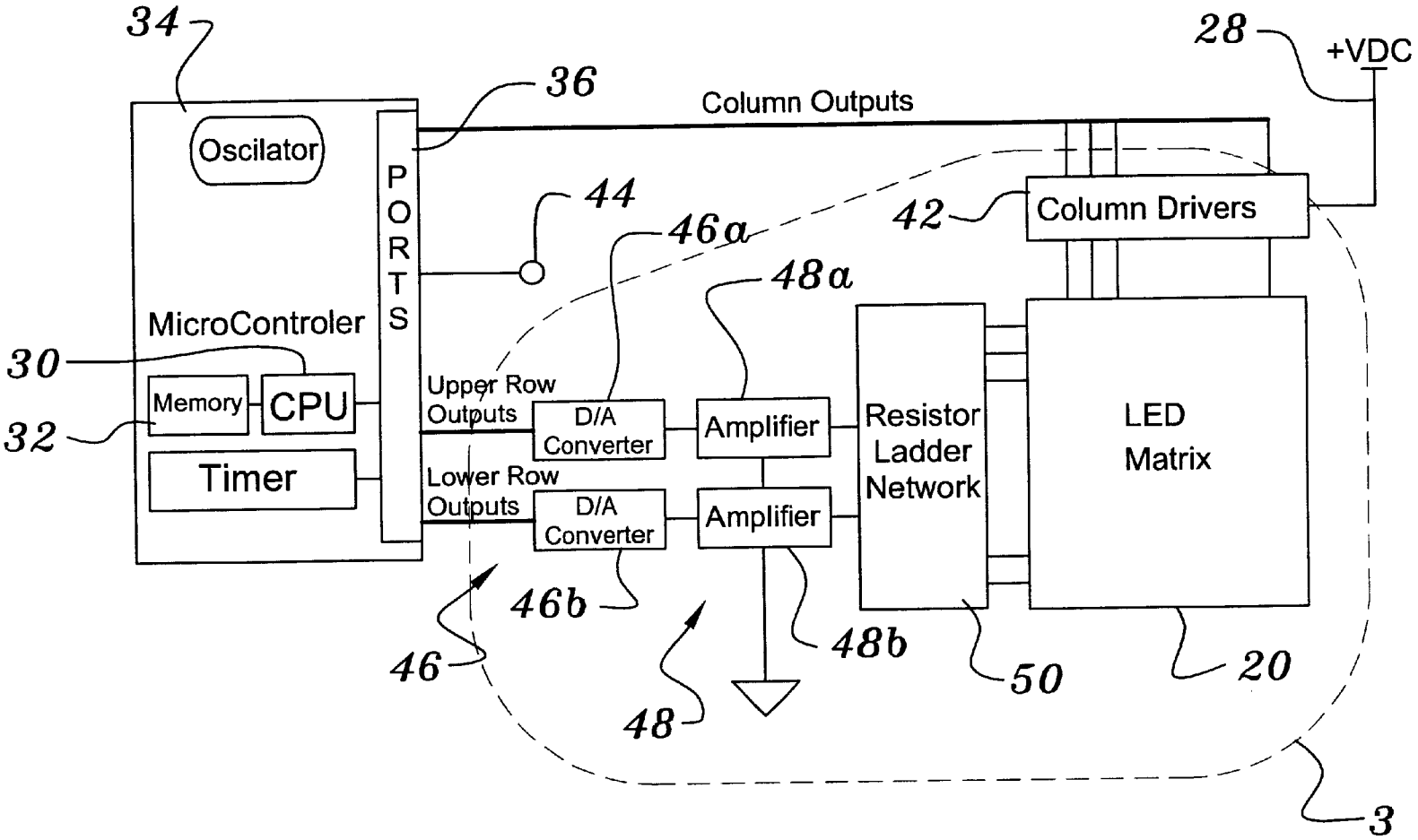
FIG. 2 is a schematic block diagram of flame simulation circuitry of the invention.

Turning now to FIG. 2, one finds a block diagram of preferred apparatus of the invention 10 powered from a DC source 28 which may, in turn, be powered from an AC mains supply, a step-down transformer, or battery (not shown). A computer 30 operates under control of a program stored in memory 32 to control the other simulation apparatus 10. In a preferred embodiment the computer may be a portion of a microcontroller 34, which is preferably a Model 16C57C microcontroller made by the Microchip Corporation, but which may be any of a number of commercially available microcontrollers.

The microcontroller 34 has some predetermined number of binary output ports 36 that can be used to control the array 20. Although it is well known to drive an N×M array by selecting a microcontroller having N×M output ports, this approach becomes prohibitively expensive as the size of the array increases. As will be disclosed in greater detail hereinafter, one of the goals accomplished by the present invention is a severe reduction in the number of output ports that are needed. In one preferred embodiment a one hundred twenty element array comprising fifteen columns of eight LEDs each is successfully controlled by a microcontroller having only twenty output ports.

One of the things done to reduce the number of control outputs is interconnecting the light sources used to form the array. The light sources in the preferred array are wired so that one of the terminals of each light source is connected in common with a corresponding terminal of each of the other light sources in the same row and the other terminal of the light source is connected in common with all the other light sources in the same column. In the preferred embodiment depicted in the drawing, the anode 38 of each LED is connected in common with the anode of all the other LEDs in the same row to a row buss 39 and the cathode 40 of each LED is connected in common with the cathodes of all the other LEDs in the same column to a column buss 41. This allows one to simulate a flame by controlling one visible column at a time and by driving the rows in accordance with an amplitude modulating arrangement described in greater detail hereinafter.

The number of column drivers 42 may be reduced by various means. In a preferred array comprising a three-faceted quasi-cylinder 20*b* having five columns of eight rows of LEDs on each of three plane surfaces, the array is controlled in a more or less one-face-at-a-time basis using only five column drivers 42 and three blanking outputs 44. Each of the column drivers is connected to three columns, one on each face, and the blanking outputs are used to select which one of the three columns —i.e., which one of the three faces—is being driven. Thus, this embodiment selectively enables drivers for fifteen columns by using only eight binary outputs, albeit at the expense of having a separate D/A for each face.

It is known in the flame simulation arts to drive a matrix of light sources with pulse-width modulation schemes in which the perceived brightness of each LED is controlled by changing the duration, or width, of the voltage pulses used to drive the LEDs. This approach requires relatively greater computational resources than does the amplitude modulation scheme selected for the present invention.

Turning now to FIG. 2, one finds amplitude modulation apparatus comprising one or more digital-to-analog converters (D/A) 46 having digital inputs from the output ports 36 of the microcontroller 34, and having outputs to amplifiers 48, each of which is separately connected to a respective terminal of a resistor ladder network 50. In addition, each of the M rows of the array is separately connected to a terminal of the resistor ladder network 50.

In operation of the amplitude modulation apparatus of the invention, a binary encoded digital value is loaded into one or more of the output ports 36. For example, if up to sixteen different amplitudes are to be provided, four of the ports are set to values corresponding to a binary number having a value in the desired range. When this value is input into one of the D/As 46, an analog voltage having one of sixteen values in a selected range appears at the output of the D/A 46. The analog output voltage from the D/A 46 is amplified by the associated amplifier 48, and the amplified signal is connected through the resistor network 50 to all the M rows of the array 20. Thus, when a selected column is enabled, each LED in that column is provided with a drive current determined by the combination of the binary encoded digital value, the preset amplification provided by the amplifier 48 and the values of the resistors selected for use in the resistor network 50. In the preferred embodiment, because an inverting amplifier is used, the binary encoded values are supplied in a one's complement format so that zero represents the highest intensity. It will be appreciated that the number of different values in a range, r, will be set by the number of ports that are used to provide outputs to a D/A and will be equal to $2^r$. Thus, if a single port is used to drive a D/A, two different analog output voltages will be possible, each corresponding respectively to a one or a zero digital value encoded at the port.

Figure 3:
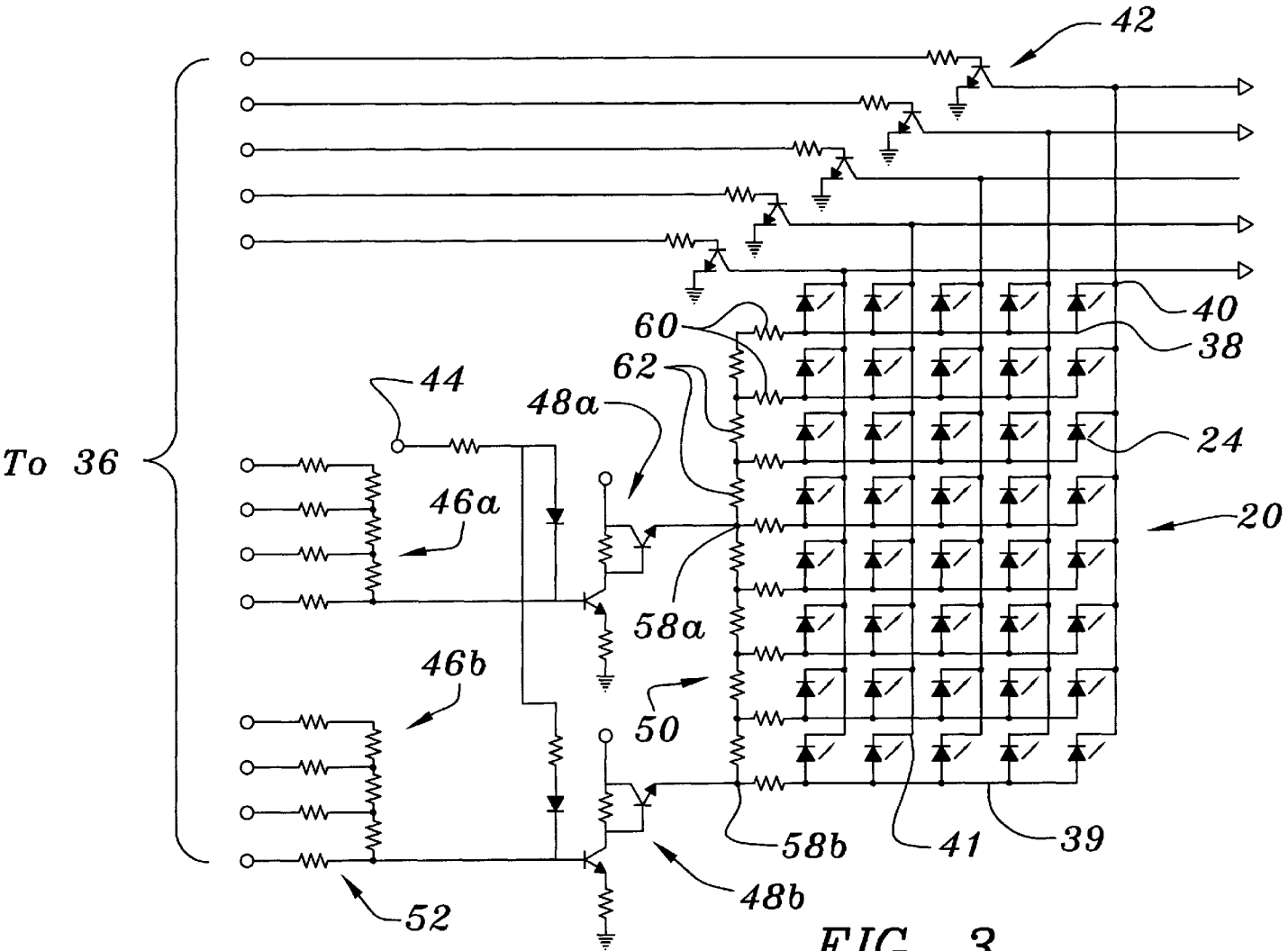
FIG. 3 is a detailed circuit diagram of a portion, indicated with the numeral 3, of the circuitry of FIG. 2.

In the embodiments depicted in FIGS. 2 and 3, eight output ports 36 each supply a binary value to two D/As 46*a*, 46*b*, each of which has four inputs, providing a one-of-sixteen resolution. As depicted in FIG. 3, each of the D/As 46*a*, 46*b* may comprise a resistive network 52 connected between selected ones of the port and respective amplifiers 48*a*, 48*b* each of which may comprise the depicted combination of two transistors and two resistors. It is noted that although the embodiment using the three-faceted array 20*b* uses a total of six amplifiers, one each for the upper rows and for the lower rows of each of the faces, the drawing shows only one pair of amplifiers in the interest of clarity of presentation. Each of the amplifiers 48*a*, 48*b* is selectively enabled or disabled by means of a respective blanking output 44 from the microcontroller 34. As is well known in the electronic arts, the function of the amplifiers 48 is to allow a logic level output from the microcontroller 34 to provide a sufficient current to drive one or more LED, or one or more columns of LEDs, in the array 20 to a desired brightness level.

Those skilled in the art will appreciate that although two analog outputs are generated by the exemplar circuit, that one could use some other number. One D/A 48, driving all the rows would, of course, be an option. It would also be possible to use an uneven segmentation of the output ports and to use, for example, five of eight ports to supply an input to a first D/A and the remaining three of the eight ports to drive a second D/A. Three or more D/A converters are also within the scope of the invention, as is the use of more or fewer output ports. The preferred embodiment uses two D/As in order to provide a simulated flame having a relatively stable, and more intense, lower portion combined with a more variable, and less intense, upper portion.

The depicted circuit arrangement uses a resistor ladder 50 having input connections 58*a*, 58*b* at two points. Both of these connections may be driven simultaneously by the two D/As 46*a*, 46*b*. Because the upper portion of a tiki torch flame is not as bright as the lower portion, the values of the resistors in the ladder 50 are chosen so that the total resistance the ladder interposes between either input connection 58*a*, 58*b* and a row in the matrix 20 is greater for rows that are nearer the top of the matrix. In the embodiment depicted in FIG. 3 the resistor ladder network comprises a number of "rung" resistors 60 (shown in a horizontal setting) nearly equal to the number of rows. These rung resistors 60 range in value from a low of thirty three ohms in the bottom row to a high of nearly five hundred eighty ohms in the top row. The vertically depicted "siderail" resistors 62 that extend between the rung resistors in this ladder have values ranging between one and six ohms. It will be understood by those skilled in the art that many different combinations of resistor values may be selected, and that the choice will vary with the characteristics of the flame to be simulated.

The flame simulation apparatus of the invention is thus operated by supplying sequence of binary-encoded outputs at the microcontroller ports, converting these binary encoded outputs into one or more analog voltages that are supplied to a resistor ladder network 50 that has a separate output connection to each row of the matrix. A single column of the array is then enabled and the light sources in that column provide respective brightness outputs responsive to the value of the binary-encoded outputs and to the fixed weighting values provided by the resistor ladder 50. In a preferred embodiment, this process is repeated with a different set of outputs and a different enabled column so that each column is turned on in a non-overlapping sequence. Each is on for a fixed time interval during which the analog intensity controlling voltages are applied to the rows so that each LED in the column lights up with a controlled intensity. The switching operations are carried out quickly enough so that a viewer perceives a continuous integrated effect and does not see individual columns being lit and extinguished.

Figure 4:
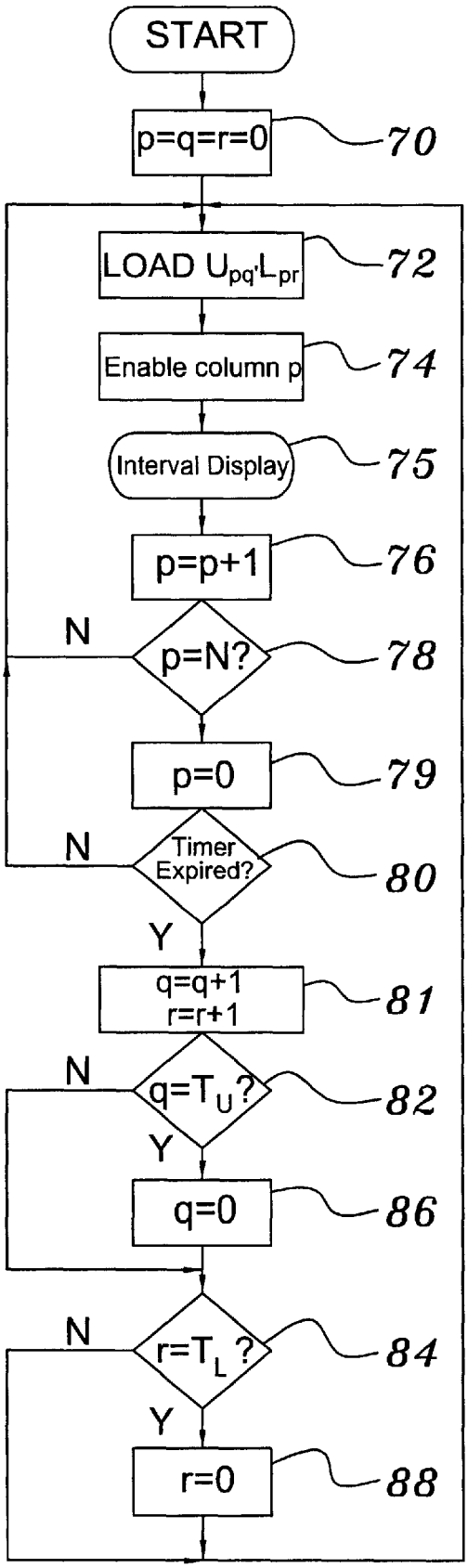
FIG. 4 is a flow chart depicting steps in the operation of a flame simulation of the invention.

There are many possible approaches to generating a sequence of sets of binary-encoded output values for controlling the intensity of illumination of various elements of the array. The more acceptable of these will provide for a relatively long sequence so that someone viewing the simulated flame is not aware of whatever repetition may occur. One such approach to a simulation method would be to use a pseudo-random number generating algorithm. In a preferred embodiment, as depicted in FIG. 4, a lookup table approach is used to control two D/A converters 46*a*, 46*b*.

The preferred method of operation stores separate tables of intensity values for the upper portion (i.e., D/A 46*a*) and the lower portion (D/A 46*b*) of the array. Each table stores a number of values equal to the number of columns in the array, N, times the number of array scans to be completed before the sequence repeats. In a preferred arrangement the upper and lower tables each have a separate value of the number of array scans, labeled $T_U$ and $T_L$, respectively. In order to maximize the total number of scans before the sequence repeats, $T_U$ and $T_L$ are selected to be relatively prime—i.e., to be unequal and to have no common divisor. In this case, although the bottom and top of the array individually repeat more often, the total simulated flame pattern only repeats after $T_U * T_L$ column operations. The upper table can be described as a set of values, $U_{pq}$, where the first index, p, ranges over N values, one for each column in the matrix, and the second index q, ranges over $T_U$ values. Corresponding, the lower table can be described as $L_{pr}$, with p running from 0 to N−1 and r running from 0 to $T_L$−1.

In operating a matrix 20 with a preferred table lookup method, the microcontroller 34 operates under control of a stored program and initially resets the indices (Step 70). The current values of $U_{pq}$ and $L_{pr}$ are then fetched from memory and loaded into the designated output ports (Step 72). A column is then enabled (Step 74), causing the amplitude modulation apparatus to illuminate a column of the matrix with intensity values corresponding to the values of $U_{pq}$ and $L_{pr}$. After waiting a selected flicker fusion interval (Step 75) the column index, p, is then incremented (Step 76) and tested (Step 78) to see if all the columns have been scanned. If not, another set of $U_{pq}$ and $L_{pr}$ values are fetched and another column illuminated. When all the columns have been selected in turn, the value of p is reset (Step 79), and if a selected interval that corresponds to the period between animation steps has expired (Step 80), the scan indices, q and r, are incremented (Step 81) and tested (Steps 82, 84) to see if either the upper or the lower table has been exhausted. If not, the next scan in the sequence is carried out. If either of the upper or lower tables has been exhausted, the appropriate index is reset (Steps 86, 88) and the table is re-used.

The flicker-fusion interval test (Step 75) controls the time that each LED is turned on. In order to avoid displaying a perceptible flicker, it is preferred to refresh each LED about one hundred times per second. For example, if the display has fifteen columns, the flicker interval should be about seven tenths of a millisecond (i.e., one fifteenth times one one hundredth). Because program execution time contributes to the overall flicker fusion time, the interval is preferably reduced from that calculated value (e.g., 0.0007 sec) by the time required to execute the loop. This loop execution time, of course, depends on the components selected for use in the circuit.

The table lookup method admits of many variations. For example, one can occasionally alter the duration of the selected interval after a column is enabled—e.g., by the use of yet another table of wait values—and thereby further improve the illusion that the simulation appears aperiodic. Additional upper or lower tables may also be introduced to change the LED intensities so as to allow an illusion of an occasional flare-up as might be caused by a gas pressure variation in a real garden torch. Moreover, although the method is described above with reference to controlling apparatus having two D/As, each of which has a 4-bit input, it will be recognized that a similar approach holds for more or fewer D/As, and does not depend on each of the D/As having the same number of bits input.

In simulating a flame, it is desirable to provide for both variations in intensity (e.g., as may be caused in a real liquid-fuel torch by increasing the exposed length of wick) and in the rate at which the flame moves about (e.g., as may be caused by air currents acting on a real flame). In the simulation of the present invention, there are several approaches for providing user control of both of these parameters. The overall intensity can be controllably altered by changing the voltage supplied to the LED array (e.g., by means of a manually adjusted potentiometer (not shown) that would allow a user to turn a knob simulative of a wick-length adjustment knob); by providing a user-operated multi-pole switch (not shown) to provide an input from which the microcontroller could calculate, or look up, a parameter used to change the intensity values corresponding to the tabulated values of $U_{pq}$ and $L_{pr}$; or by other means known to the control arts. The flame animation rate can also be controlled in a variety of ways. For example, a user-operated multi-pole switch could be read by the microcontroller to obtain input values of the selected animation time interval. In one preferred embodiment, however, the period between animation steps is a terminal count value input by the programmer and tested (Step 80) during the operation of the program. Alternately, the terminal count value could be a variable that is calculated by a subroutine (not shown) that would allow the speed of animation to vary with time so as to simulate a variable air current.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. An apparatus for simulating a flame by sequentially controlling a respective intensity of illumination provided by each of a selected number, greater than one, of light sources disposed in a vertically extending array thereof, each of the light sources for providing a respective intensity of illumination responsive to an amplitude of a respective voltage applied to a terminal thereof, the apparatus comprising:

a controller having a memory operatively associated therewith, the controller operable under control of a flame simulation program stored in the memory, the controller comprising a plurality of output connections for supplying at least one binary-encoded output value;

the flame simulation program for controlling the controller to provide the at least one binary-encoded output value;

at least one digital-to-analog converter connected to the controller to receive the at least one binary-encoded output value therefrom, the digital-to-analog converter for converting the received at least one binary-encoded output value to a corresponding at least one analog voltage at a respective at least one digital-to-analog output; and the selected number of electrical connections, each of the electrical connections respectively connecting the digital to analog output to one of the selected number of light sources, each of the electrical connections comprising a respective electrical resistance uniquely associated with a resistive ladder network, whereby the amplitude of the voltage applied to the respective terminal of each of the light sources is responsive to both the amplitude of the analog signal and the value of the respective electrical resistance.

2. The apparatus of claim 1 wherein the light sources are arranged as a matrix comprising N vertical columns and M horizontal rows, wherein N and M are respective numbers greater than one; wherein each of the light sources comprises two electrical terminals, one of the terminals of each of the light sources electrically connected to exactly one of N column busses, the other of the terminals of each of the light sources connected to exactly one of M row busses.

3. A method of simulating a flame having an upper portion that is not as bright as a lower portion by controlling a plurality of electrically-powered light sources spaced out at a selected number of positions along at least one vertical column, each of the light sources providing a respective illumination intensity responsive to a voltage supplied to a respective input terminal thereof, the method comprising the steps of:

generating, by means of a program stored in a memory of a computer, a sequence of binary-encoded values, each of the binary-encoded values representative of a respective light intensity;

supplying the sequence of binary encoded values to at least one digital to analog converter;

converting, by means of the at least one digital to analog converter, the sequence of binary encoded values to a corresponding sequence of analog voltages;

applying the sequence of analog voltages to an input of a resistor ladder network having the selected number of output connections, each of the output connections connected to an input terminal of at least one of the light sources, the resistor network selected to interpose a resistance between the input and a selected one of the light sources that is greater than the resistance the network interposes between the input and any other light source disposed below the selected one of the light sources in the vertical column thereof.

4. The method of claim 3 wherein each of the light sources comprises a respective light emitting diode.

5. The method of claim 3 wherein the plurality of light sources are arranged as a matrix comprising a plurality of columns, each of the columns having a respective column buss associated therewith, and a selected number of rows, each of the rows having a respective row buss associated therewith, wherein one of two input terminals of each illumination source is electrically connected to exactly one of the selected number of row busses and wherein the second terminal of each illumination source is connected to exactly one of N column busses.

6. The method of claim 3 wherein the plurality of illumination sources are arranged as a matrix comprising N columns, where N is a number greater than one, and wherein the steps of generating the sequence of binary encoded values, converting the binary encoded values to a corresponding sequence of analog voltages and applying the sequence of analog voltages to a resistor ladder network are separately carried out for each of the N columns.

7. The method of claim 3 wherein the recited steps are repeated and wherein the program generates a second sequence of binary encoded values different from the initially generated sequence of binary encoded values.

8. The method of claim 3 wherein each of the light sources comprises a respective LED and wherein the steps of generating the sequence of binary encoded values, supplying those values to the at least one digital to analog converter and applying the sequence of analog voltages to the input of the resistor ladder network are repeated frequently enough so that each of the LEDs provides the respective illumination intensity at least one hundred times per second.

* * * * *